United States Patent [19]

Booze

[11] Patent Number: 4,799,325

[45] Date of Patent: Jan. 24, 1989

[54] AUXILIARY RIFLE SIGHT

[76] Inventor: Raymond F. Booze, 8539 Cole St., Downey, Calif. 90242

[21] Appl. No.: 119,021

[22] Filed: Nov. 10, 1987

[51] Int. Cl.[4] ..... F41G 1/00; F41G 11/00

[52] U.S. Cl. ..... 42/100; 42/101; 33/250

[58] Field of Search ..... 42/100, 101, 102; 33/250, 252, 233; D22/109, 110

[56] References Cited

U.S. PATENT DOCUMENTS

| | | | |
|---|---|---|---|
| 1,816,195 | 7/1931 | Redfield | 42/101 |
| 2,010,893 | 8/1935 | Redfield | 42/100 |
| 2,486,002 | 10/1949 | Buehler | 42/101 |
| 3,611,606 | 10/1971 | Sefried et al. | 42/101 |
| 3,880,389 | 4/1975 | Burris | 42/101 |

OTHER PUBLICATIONS

"Quick-Change Mount for Sportsmen's Rifle Sights" *Popular Mechanics,* Dec. 1950 p. 123.

*Primary Examiner*—Deborah L. Kyle
*Assistant Examiner*—Michael J. Carone
*Attorney, Agent, or Firm*—Gausewitz, Carr & Rothenberg

[57] ABSTRACT

An auxiliary rifle sight for attachment to the telescope mounting elements of a rifle, and having front and rear sight devices, which, along with couplers, are dimensioned, configured and arranged for being received within and/or coaction with the existing geometrical form or shape of the front and rear portions, respectively, of the telescope mounting elements of the rifle. The rear sight device is configured for attachment to the rear portion of the telescope mounting element, such as a telescope base, and, in one embodiment, includes a block member with T-shaped cutouts in opposing sides thereof for coaction with T-shaped coupling members having the cross-arms thereof fitted within the slots, with the leg portion thereof provided with an arcuate segment having a convex outer surface for coaction with a matingly configured concave shoulder portion of a screw, tightening of the screws into the base camming the block into intimate contact with the rear scope mounting element. The front sight coacts with the existing shape of the front of the base, which may have a circular or rectangular opening, with a threaded member locking the front sight to the front mounting element with the blade of the sight in alignment with the rear sight. Other embodiments are shown and described.

26 Claims, 2 Drawing Sheets

FIG. 1.
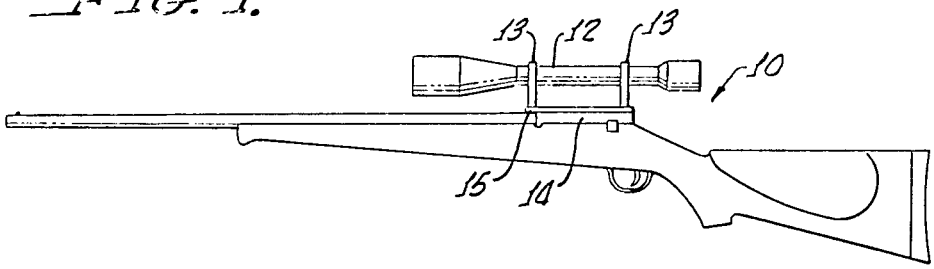
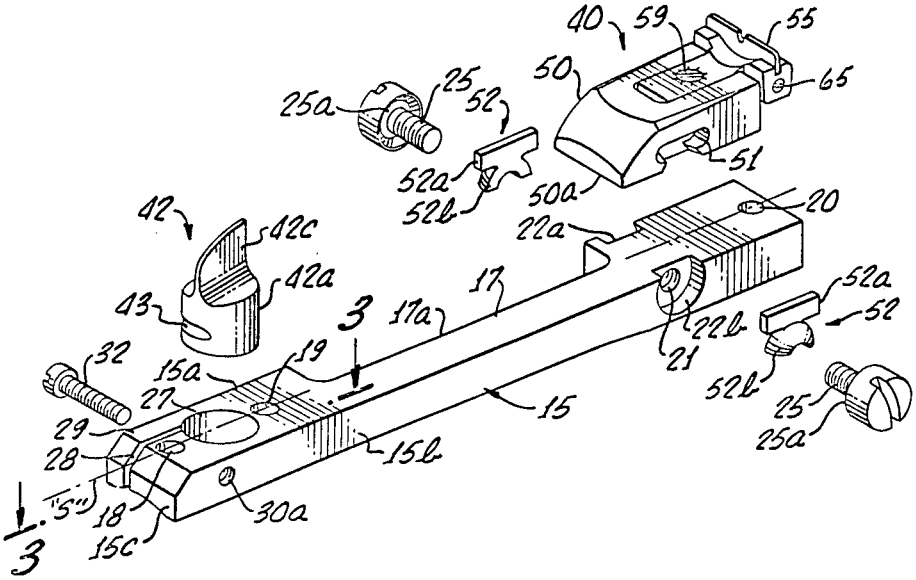
FIG. 2.
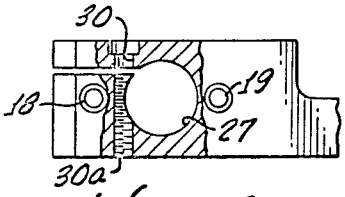
FIG. 3.
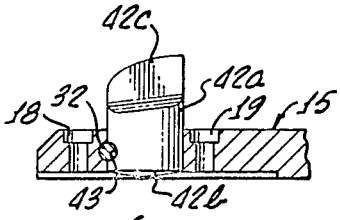
FIG. 4.
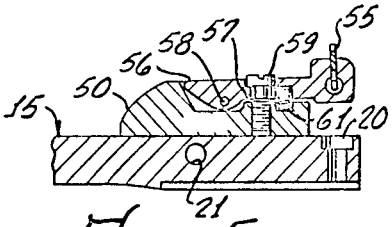
FIG. 5.
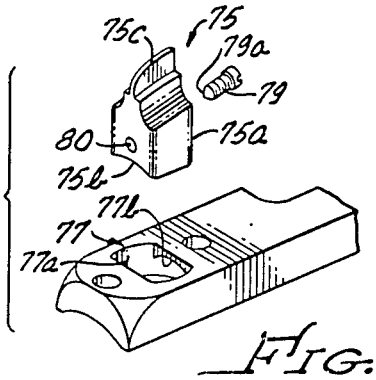
FIG. 6.
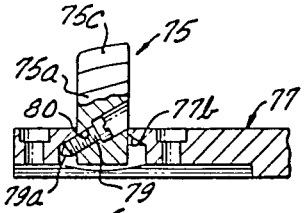
FIG. 7.

AUXILIARY RIFLE SIGHT

BACKGROUND OF THE INVENTION

The background of the invention will be discussed in two parts.

FIELD OF THE INVENTION

This invention relates to auxiliary rifle sights, and more particularly, to rifle sights for use in lieu of a damaged or optically impaired telescopic sight on a rifle.

DESCRIPTION OF THE PRIOR ART

Hunting with high powered rifles is conducted in the wild, in widely differing climates, and many times in location which are remote from civilization. Hunting expeditions can take the sportsman into high altitudes, and frigid weather. For hunting bighorn sheep and mountain goats, a typical expedition can last a week or more, with shots of 300 yards or more not being uncommon. With the advent of telescopic sights, such long range shooting has been substantially enhanced. However, many rifles of modern design are available with telescopic sights only, that is, there are no open sights or "iron sights" on the rifle. Open sights, or iron sights on a rifle take the form of a rear sight which is adjustable for elevation and windage, and a front fixed sight attached to the upper side of the barrel adjacent the barrel opening, with the spacing of the two sights being from a position forward of the receiver to the front of the barrel, a distance of twelve to eighteen inches apart. With a telescope equipped rifle, the telescope is mounted to the rifle by means of mounting rings which receive the barrel of the telescope, with the mounting rings then being coupled to the receiver of the rifle, usually by means of a telescope base or platform. In many rifles, in order to fit the telescope closer to the barrel, the open or iron sights are omitted from the rifle. One of the reasons is that the length of the scope, along with the diameter of the front lens portion, places the front of the scope at the position where the rear iron sights would normally be located.

Such big game rifles are typically provided with telescope mounting elements, separately attachable to the rifle at the receiver, or integrally formed in the receiver. Two typical separately attachable telescope mounting bases, which have common features, are those sold under the names of Redfield and Buehler. The mounting base of each of these is formed as a unitary generally bar-shaped metal member having a reduced width portion for spanning the spent cartridge ejection opening of the receiver. For attachment purposes, the receiver of the rifle is provided with telescope base positioning means in the form of threaded apertures, usually three or four, and usually in extremely precise alignment with the sight line of the rifle, that is, on a line pointing down the barrel. The forward and rearward ends of the telescope mounting base are provided with a like number of countersunk apertures in alignment with the receiver apertures. The undersurface of the telescope base is contoured to the diameter of the receiver for providing a very tight mating fit to the receiver portion of the rifle. In this manner, the telescope base is aligned and oriented to the sight line of the rifle. The telescope is then attached to the base, such as by scope rings having attachment portions configured for engagement with precision machined mating portions of the telescope base. Other telescope mounting elements may be formed in two parts for attachment to the threaded apertures in the receiver. In a rifle manufactured by Sturm, Ruger & Company, Inc., the telescope mounting elements are integrally formed in the receiver itself, such as by longitudinally extending pairs of tapers or grooves with an intermediate transversely extending detent for enabling attachment and positioning of the telescope mounting rings.

Telescopic sights are optical instruments, which in many instances, such as with variable powered scopes, have a complex lens mechanism. As with any lens-type instrument, the glass is subject to breakage, or the lenses are subject to displacement, through impact or jarring. When scaling rocky terrain of mountainous areas, dropping of a rifle is not an uncommon occurrence. Furthermore, in cold or moist climates, the telescopes are subjected to an internal accumulation of moisture, resulting in a fogged lenses which cannot be readily cleaned, thus, as a minimum, drastically obscuring vision. In transporting rifles with telescopic sights, such as by air baggage, the rifle and scope could be dropped and damaged without the sportsman being aware until he arrives at his destination. In the event the telescope becomes impaired or damaged so as to render it unusable, and with a weapon with no iron sights, the hunter can very quickly find himself with a hunting expedition of many days duration, and a virtually unusable weapon. Although the telescope can be removed from the telescope base with a simple tool, the absence of iron sights precludes effective use of the rifle.

In accordance with an aspect of the invention, it is accordingly an object of the invention to provide a new and improved auxiliary rifle sight arrangement which can be readily fit to the telescope mounting elements of the rifle.

SUMMARY OF THE INVENTION

The foregoing and other objects of the invention are accomplished by providing an auxiliary rifle sight apparatus for attachment to the telescope mounting elements of the rifle, the apparatus including a rear sight device for attachment to the rear mounting portion of the telescope mounting elements and a front sight device for attachment to the front mounting portion of the telescope mounting elements of the rifle. The rear sight device is provided with a notched sight blade or leaf member which may be adjusted vertically for elevation and laterally for windage. The front sight device has a post or bead sight or the like, for attachment to the front or forward telescope mounting element in fixed relation to the rear sight and, hence, along the gun sight line. The rear sight device is configured for coacting engagement with the existing geometrical shape or form of the rear portion of the telescope mounting element of the rifle, such as the telescope base, and, in one embodiment, includes a rear sight block member with T-shaped slots in opposing sides thereof for coaction with T-shaped coupling members having the cross-arms thereof fitted within the slots, with the leg portion thereof provided with an arcuate segment having a convex outer surface for coaction with a matingly configured concave shoulder portion of a screw member. The screw members are inserted into threaded apertures in the sides of the rear mounting element and are preferably the same screw members used to attach the scope at the rear. The T-shaped members provide lateral support for retaining the rear sight block member of the rear sight device in position, while urging the undersurface of the block member into tight abutting relation with the upper surface of the rear portion of the telescope mounting element while the screws are tightened. The front sight device is configured for coacting engagement with the existing geometrical configuration of the front portion of the telescope mounting elements. In the Redfield telescope base, the front portion is configured with a transversely extending slotted opening having a chamfer or taper on the undersurface thereof adjacent the front edge of the slot. The front sight device is configured for insertion within the slotted opening, with an angularly oriented threaded aperture therein, with a pointed screw member passing therethrough engaging the undersurface at the tapered edge. In the Buehler type telescope base, the forward portion is provide with a circular aperture, with a transversely extending keying aperture in the base for receiving a threaded shaft member therethrough. The front sight device is configured for being received within the circular aperture and is provided with a transverse groove for coaction with the shaft for locking the sight into proper orientation. Other embodiments are described for attachment to Weaver telescope mounting elements and to the receiver of a Ruger rifle. In any event, the front and rear sight devices, along with the couplers, are dimensioned, configured and arranged for being received within and/or coaction with the existing geometrical form or shape of the front and rear portions, respectively, of the existing telescope mounting elements of the rifle.

Other objects, features and advantages of the invention will become readily apparent from a reading of the specification, when taken in conjunction with the drawings, in which like reference numerals refer to like elements in the several views.

BRIEF DESCRIPTION OF THE DRAWINGS

FIG. 1 is a side elevational view of a conventional rifle with a telescopic sight mounted thereon;

FIG. 2 is an exploded perspective view of the auxiliary sight arrangement of the present invention relative to one form of telescope base member;

FIG. 3 is a partial top plan view of the forward end of the telescope base of FIG. 2, partially broken away, as viewed general; along line 3—3 thereof;

FIG. 4 is a cross-sectional view of the forward end of the base of FIG. 3, as viewed along line 4—4 thereof, with the front sight device according to the invention retained therein;

FIG. 5 is a cross-sectional view of the rear sight assembly of FIG. 1, as viewed generally along line 5—5 thereof, shown assembled to the telescope base;

FIG. 6 is a partial exploded view of the forward end of an alternate telescope base with an alternate front sight device therefor;

FIG. 7 is a cross-sectional view of the forward end of the alternate telescope base, with the alternate front sight device according to the invention retained therein;

DESCRIPTION OF THE PREFERRED EMBODIMENT

Figure 8:
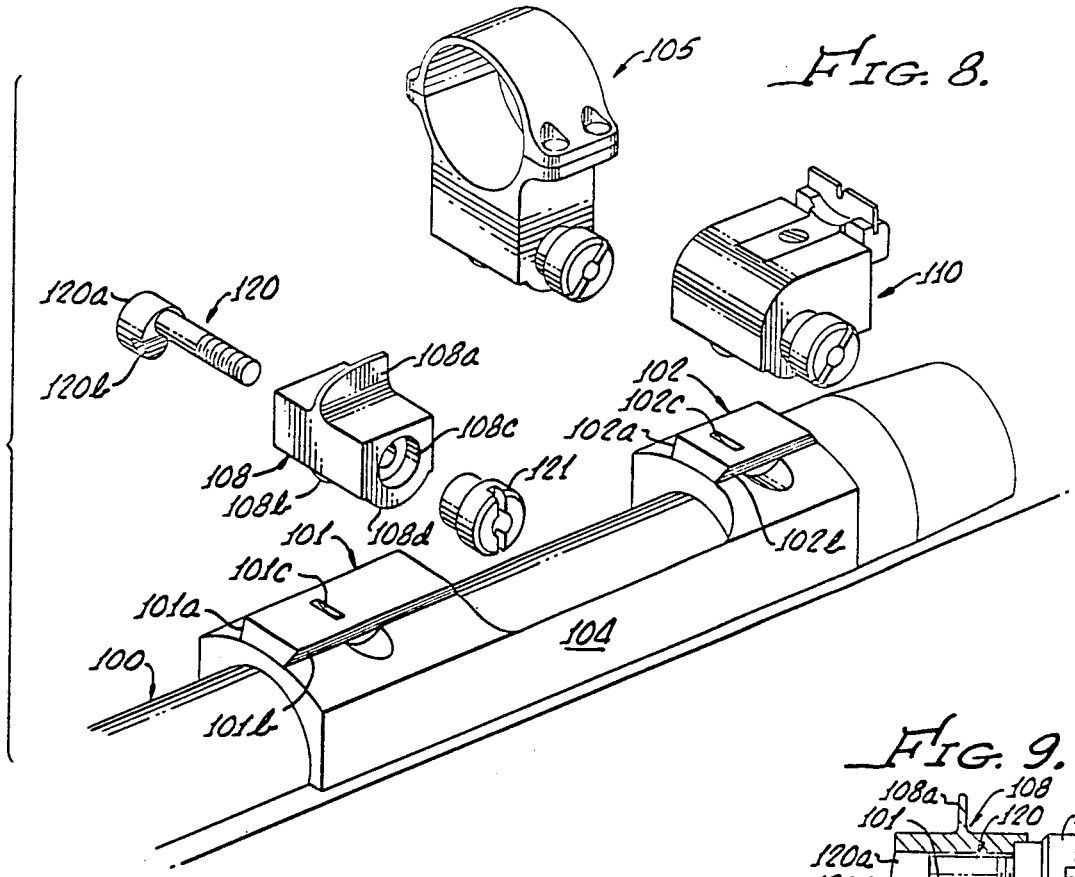
FIG. 8 is an exploded perspective view of the receiver portion of a rifle having integrally formed telescope mounting elements.

Referring now to the drawings, and particularly to FIG. 1, there is shown a rifle, generally designated 10, with a telescope 12 attached thereto atop the receiver portion 14. In the majority of such cases, with high-powered rifles, the rifle receiver portion 14 is provided with telescope positioning or alignment means, such as a plurality (usually three or four) of threaded apertures, arranged in alignment with the gun sight line, that is a line parallel to the line of travel of a bullet through the bore of the rifle barrel. Two of these threaded apertures are in the forward portion of the receiver portion 14, and one or two are aft thereof, and all four are machined and positioned with extreme accuracy to insure proper optical alignment of the telescope relative to the rifle barrel and the sight line. The receiver 14 is that portion of the rifle into which cartridges are inserted, and from which spent cartridges are ejected. This Portion of the rifle is of larger diameter than the barrel, and the drilling and tapping of the apertures presents no obstruction to the operation of the rifle.

In many conventional rifles with telescopic sights, the iron sights do not exist, that is, the manufacturer not only does not install them, hut makes no provision for them. To install the telescope, some form of telescope mounting elements are required. In the majority of instances, this need is satisfied by the installation of a telescope mounting base !5, which is attached to the receiver 14, with a pair of rings or clamps 13 encircling the barrel portion of the telescope 12 for securing the telescope 12 to the base 15.

The telescope base 15 is machined from a generally elongate bar-shaped piece of stock, preferably steel, with opposite generally parallel long sides **15*a* and 15*b*. The undersurface 16 thereof is radiused or contoured to conform to the diameter of the receiver portion 14 to which it is attached. The base 15 has a central reduced width portion 17, which is formed by cuting into the edge 15*a* and which is tapered on the long edge 17*a* thereof to provide clearance for cartridge insertion or ejection, with the portion 17 spanning the cartridge ejection opening at the receiver portion 14 of the rifle 10**.

As shown, there are three countersunk apertures 18-20 extending through the base member 15, all three of which are on a common line, designated "S", the three apertures being accurately spaced and positioned for precise alignment with the three threaded apertures in the receiver 14 of the rifle 10, two apertures 18 and 19 forward and one aperture 20 aft of the receiver opening. This line "S" is parallel to the gun sight line of the rifle 10 with the base 15 attached thereto. The rear portion of the base 15 is provided with laterally extending aligned threaded apertures 21 (only one of which is shown), with the edges **15*a* and 15*b* being appropriately symmetrically cutaway portions at 22*a* and 22*b* about the axis of the apertures 21 to accommodate receipt of the heads of screw members 25, along with matingly configured portions of the ring members. The screw members 25** are referred to as cupped screws, that is the shoulder 25*a* of the underside of the head portion is of convex configuration to form a cup for assisting in retention of the connected component These screw members 25 are the existing screw members used to secure the rear ring 13 to the base 15

The front end of the base 15 is provided with an opening 27 of circular configuration, the axis of which extends along a line perpendicular to the abuttingly contacted surface of the receiver portion 14, that is in a vertical direction. A lengthwise offset slot 28 extends from the front end 15*c* of the base 15 into communication with the opening 27 in tangential relation with the circumference thereof adjacent the edge 15*a*. This slot 28 is offset from the longitudinal centerline of the base 15 to produce a thin strip 29 adjacent the edge 15*a*. A laterally oriented aperture 30 (See FIG. 3) extends through the strip 29 from the edge 15*a*, with the aperture being in alignment with a smaller diameter threaded aperture portion 30*a*, for receiving a threaded member 32 therein to thereby act as a clamp for the front scope mounting element. As can be seen in FIGS. 2 and 3, the shaft of the threaded member 32 protrudes into the opening 27 in tangential relation along a line almost exactly perpendicular to the longitudinal centerline of the base 15, which centerline coincides with the gun sight line of the rifle 10. Again, the base 15, the cupped screws 25, the opening 27, the slot 28, the strip portion 29 and the threaded member 31 are all part of the conventional mounting arrangement for the telescope 12.

in accordance with the invention, for this particular form of telescope mounting element or base 15, the auxiliary rifle sight includes a rear sight assembly or device, generally designated 40, and a front sight assembly, generally designated 42. As will be described, these assemblies are configured to fit into coacting interengagement with pre-existing geometrically configured portions of the telescope base 15, utilizing the existing fasteners provided for mounting of the telescope 12.

The front sight assembly 42 includes a body portion 42*a* of cylindrical configuration of the same diameter as the diameter of the opening 27 for being received therein. The undersurface is contoured or radiused, as indicated at 42*b* of FIG. 4 to conform to the undersurface of the base 15 at the front end thereof. Integrally formed with the body 42*a* is an upwardly extending front sight blade member 42*c*, the plane of which is intended to lie on a plane extending through line "S" Within the vertical dimension of the opening 27, the body portion 42 is provided with a transversely extending groove 43, that is, the groove 43 extends along a line perpendicular to the plane of the sight blade 42*c*. As shown in FIG. 3, with the shaft of the threaded member 32 inserted into aperture 30, the front sight device 42 is keyed and locked in position with the plane of the blade 42*c* lying along the gun sight line.

Referring now to FIGS. 1 and 5, the rear sight assembly 40 is configured for coacting engagement with the existing geometrical shape or form of the rear portion of the telescope mounting element of the rifle, such as the telescope base 15, and includes a rear sight block member 50, the undersurface 50*a* of which is contoured to conform to the upper surface of the rear portion of the base 15. The block 50 is provided with T-shaped slotted cutouts 51 (only one of which is shown) in opposing sides thereof for coaction with T-shaped coupling members 52 having the crossarms 52*a* thereof fitted within the slotted cutouts 51, with the leg portions thereof configured as arcuate segments 52, each having a convex outer surface for mating coaction with the matingly configured concave shoulder portions 25*a* of the screw members 25. The screw members 25 are inserted into the threaded apertures 22*a*, 22*b* in the sides of the rear portion of the base 15, and, as previously stated, these screws 25 are the same screw members used to attach the scope at the rear.

For assembly of the block 50 to the base 15, the block 50 is positioned atop the base 15 at the rear thereof. With the screws 25 partially engaging the apertures 22*a*, 22*b*, the arcuate segments 52*b* of the T-shaped members 52 are placed for coaction with the screws 25, and the cross-arms 52*a* of the T-shaped members 52 are positioned within the lateral slot portion of the cutouts 51. The screws 25 are then tightened, and, during this tightening, the coaction of the shoulders 25*a* of the screws 25 with the outer convex surface of the arcuate segments 52*b* serves to cam the block member 50 downwardly to urge the undersurface 50*a* thereof into tight abutting contact with the upper surface of the rear portion of the base 15. The laterally protruding cross-arm portions 52*a* of the T-shaped members 52 provide lateral support for retaining the rear sight block member 50 of the rear sight device 40 in position, while urging the undersurface of the block member 50 into tight abutting relation with the upper surface of the rear portion of the telescope base 15 when the screws 25 are tightened. In this manner, the block 50 is attached in fixed relation to the base 15, and, hence to the gun sight line of the rifle 10.

The rear sight device 40 is provided with a notched sight leaf or blade member 55 attached to a sight arm 56 which is adjustable vertically for elevation while the blade member 55 is adjustable laterally for windage. As shown in FIG. 5, the block 50 is provided with a channel 57 with sidewalls, into which the sight arm 56 is pivotally coupled to block 50 by means of a pin 58 passing through sight arm 56 and the sidewalls of the channel 57 adjacent the front end of arm 56. A countersunk aperture passes through the arm 56 for receiving a screw adjusting member 59, which is threadably received in an aperture 60 formed in the channel 57. A spring member 61 is interposed within aligned depressions between facing surfaces of the channel 57 and the arm 56 to provide an upwards bias to the arm 56, with tightening of the screw 59 operating against the bias to adjust the height of the blade member 55 at the other end of sight arm 56. Similarly, the notched blade member 55 is captively and slidably retained in a laterally extending slot 64 under force of a spring (not shown), with the lateral, or windage compensated position being accomplished by adjustment of screw member 65 (See FIG. 2).

Such elevation and windage sight adjusting arrangements are conventional in weapons with adjustable rear iron sights and are provided with adjustment screw arrangements which provide a discernible "click" upon screw rotation. Each "click" is interpreted by the sportsman as providing a certain vertical or lateral displacement of the point of impact of the bullet at a predetermined range. For example, one "click" can be interpreted as a point of impact displacement of one inch per one hundred yards.

With the auxiliary rifle sight arrangement of the present invention, the rear and front sights 40 and 42 are spaced apart the distance of the respective existing telescope mounting elements, which is a distance much less than the distance between the iron sights of a rifle without a scope, and may be, for example, between four and one-half to six inches apart. However, it has been found that this reduced sighting distance does not impair the utility of the rifle with the auxiliary rifle sight. However, with the closer spacing of the front and rears sight device 42 and 40, if a conventional screw adjusting arrangement is utilized, the interpretation of a "click" as it affects elevation or windage is different, that is, the point of impact change is greater in proportion to the ratio of the difference between normal front and rear iron sight distance and the shorter distance of the auxiliary rifle sight of the present invention. This can be remedied by provision of a different screw adjustment arrangement at the time of manufacture to provide the conventional point of impact change for each "click", or by instructions to the user of what the actual point of impact change is per hundred yards of range. In either event, to avoid downtime in the field, the auxiliary rifle sight arrangement can be sighted in by the sportsman for the same distance as the telescope 12 at the time of sighting in the scope.

In use, with an impaired telescope, the sportsman need only remove the scope and fit the front and rear sight devices 42 and 40 to the telescope mounting elements, such as the base 15, and, as thus secured, the rifle 10 is provided with iron sights fixedly and rigidly attached in precise orientation to enable use of the rifle 10.

Referring now to FIGS. 6 and 7, there is shown an alternate form of front sight device 75, which is configured to coactingly engage the forward end of an alternative form of telescope base 77, which base is of the type known as a "Redfield" base. The rear portion of the Redfield telescope base 77 is substantially similar to the Buehler base. The main difference, insofar as it impacts on the auxiliary rifle sight of the present invention is in the front mounting. In the Redfield telescope base 77, the forward end is provided with an opening **77*a* of rectangular configuration with rounded corners, with the long dimension of the opening 77*a* extending along a line perpendicular to the gun sight line. As shown in FIG. 7, the undersurface of the base 77 adjacent the front and rear of opening 77*a* is provided with a tapered or beveled edge 77*b*. This configuration enables insertion of a matingly configured rectangular post of a front telescope ring into the opening 77*a*** with a ninety degree twist locking the front post in position.

In accordance with the present invention, the alternate front sight device 75 has a rectangularly configured body portion **75*a*, dimensioned for snugly positioning into the opening 77*a*. The undersurface 75*b* of the device 75 is contoured to the curvature of the receiver portion 14 for abutting thereagainst. The upper end of the front sight device 75 is configured with a blade sight 75*c*. For securing the sight 75 within the opening 77*a*, a screw member 79 is threadably received within an angularly oriented countersunk threaded aperture 80 formed in the bottom of the base 77. The screw member 79 is provided with a pointed or slightly blunt tapered end 79*a*. The angle of aperture 80 is such that. with the device 75 within the opening 77*a*, tightening of the screw 79 causes the tapered end 79*a* thereof to contact the undersurface of the front tapered edge 77*b* of the opening 77*a*. Further tightening causes the device 75 to urge downwardly and rearwardly to thus firmly lock the front sight device 75** in precise angular position.

Figure 9:
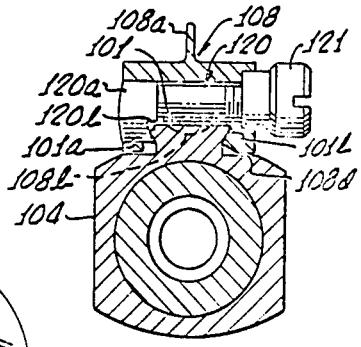
FIG. 9 is a cross-sectional view of the front sight assembly mounted to the front telescope mounting element of the rifle of FIG. 8.

Referring now to FIGS. 8 and 9, there is shown an alternate arrangement for a rifle 100 having the telescope mounting elements 101 and 102 integrally formed with the receiver portion 104 of the rifle 100. Such rifles are sold by Sturm, Ruger & Company, Inc. of Connecticut. The telescope mounting elements 101 and 102 are virtually identically configured and, by specific reference to the front mounting element 101, the elements are in the form of dovetails and include an undercut block member having a generally planar upper surface with inwardly and downwardly tapered side edges **101*a*, 101*b*, extending in the direction of the center line of the barrel. The upper surface of each mounting element is provided with a transversely directed precisely machined arcuate keying slot 101*c*, 102*c*. The component designated 105 is one of the two conventional telescope mounting rings which identical and are adapted to be secured to the mounting elements 101, 102 of the rifle 100. The underside of such rings 105 are configured with depending tabs 105*a* configured to be received within the keying slots 101*c* or 102*c*. With removal of the rings 105, the front and rear auxiliary sights 108, 110, respectively, of the present invention may then be readily and accurately attached to the mounting elements 101, 102**, respectively.

As shown in FIG. 9, the front sight element 108 has the underside thereof configured to dovetail with the mounting element 101 as well as the keying slot **101*c*. The front sight assembly 108 has a main body portion with a blade sight 108*a* formed integrally therewith. The undersurface which engages the upper surface of the mounting element 101 is provided with a depending tab 108*b* for keying within slot 101*c*. A laterally extending opening 108*c* is provided through the main body portion for receiving fastener members 120, 121. One edge of the main body portion of the sight assembly 108 is provided with an integrally formed depending tang portion 108*d* which has an inwardly extending V-shaped groove configured for engagement with a tapered side 101*b* of the telescope mounting element 101**

The fastener member 120 is in the form of a threaded member with an offset head portion **120*a*, the projecting portion of which is configured with a V-shaped groove 120*b* configured to coact with the tapered side edge 101*a* of the mounting block member 101. For assembly, the front sight assembly 108 is positioned atop the surface of element 101, with the tab 108*b* positioned within the slot 101*c*, and the groove of the tang portion 108*d* engaging the tapered side 101*b*. The threaded member 120 is passed through the opening 108*c* with the V-shaped groove 120*b* aligned for coaction with the tapered side 101*a*. Fastener member 121 is an internally threaded slotted nut member, which is threaded onto the threaded shaft of member 120, with tightening thereof securely affixing the front sight assembly 108 to the mounting element 101, as shown in FIG. 9. The keyed slot 101*c* is precisely perpendicular to the sight line, and the upper edges of the sides 101*a* and 101*b* are parallel to one another and to the gun sight line of the rifle 100. The blade sight 108*a* is dimensioned and positioned to be precisely on the gun sight line with the assembly 108 thus attached. The rear sight assembly 110 likewise includes the tab 110*a* on the bottom thereof with fasteners identical to fasteners 120 and 121 for assembly of the rears sight assembly 110 to the rear telescope mounting element 102**.

Figure 10:
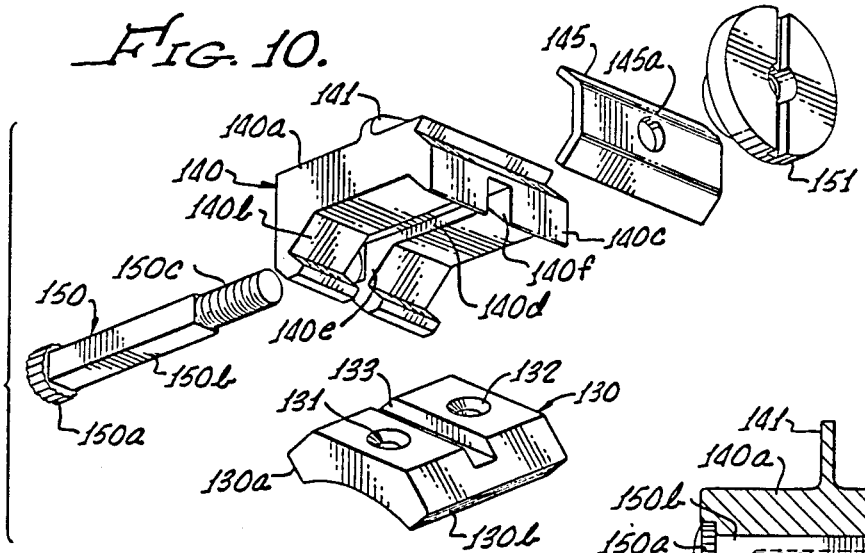
FIG. 10 is an exploded perspective view of another embodiment of the front sight of the auxiliary sight assembly.
Figure 11:
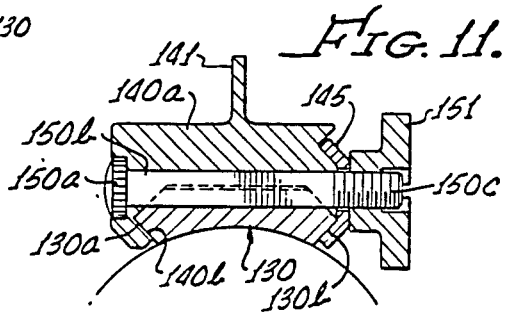
FIG. 11 is a cross-sectional view of the front sight assembly of FIG. 10 in assembled relation with the telescope mounting element.

FIGS. 10 and 11 show yet another embodiment configured for coupling to telescope mounting elements of a type known as a "Weaver" telescope mount. For this mounting arrangement, the Weaver telescope mounting system consists of a pair of telescope mounting blocks 130 (only one of which is shown), the block 130 having a pair of apertures 131, 132, for securing to the rifle adjacent the receiver portion. Keying of the telescope to the block 130 is accomplished by means of a transversely extending groove 133. The opposite sides 130*a* and 130*b* of the block 130 are configured with outwardly extending V-shaped edges.

The auxiliary rifle sight assembly is configured for engagement with this mounting block 130. Only a front sight assembly 140 is shown, it being understood that the rear sight assembly would have corresponding parts. The main body portion 140*a* of the sight assembly 140 has he undersurface thereof configured for mating coaction with the upper surface of the block 130. A first depending side portion 140*b* is provided with a V-shaped groove for coaction with the edge 130*a*, while the opposite depending side is somewhat shorter and configured to abut against the upper surface portion of the V-shaped edge 130*b*. A somewhat U-shaped clamp member 145 is configured to conform to the side 140*c* with a lower lip portion thereof engaging the undersurface of the block 130*b*. The undersurface of the body portion 140*a* is provided with a transversely extending groove 140*d* in alignment with an aperture 140*e* and a slot 140*f*.

A threaded fastener 150 having a knurled head 150*a* and a square shaft 150*b* with a threaded end 150*c* fits within the groove 140*c* when passed through the aperture 140*e* and slot 140*f*. The clamp member 145 is provided with an aperture 145*a*, through which passes the threaded end 150*c* of the fastener 150. A threaded nut member 151 is then threaded onto the end 150*c*. When assembled, as shown in FIG. 11, the square shaft 150*b* of the fastener 150 fits snugly and non-rotatably within the matingly configured groove 133 of the block 130, to thus secure the front sight assembly 140 on the mounting block 130 with the blade sight 141 thereof in precise orientation relative to the gun sight line of the rifle.

In accordance with the present invention, there has been shown and described an auxiliary rifle sight arrangement which can be readily attached to the pre-existing portions of the telescope mounting elements of a telescopically equipped rifle. While the description has referred to four known types of telescope mounting elements, it is to be understood that the telescope mounting elements of a particular rifle can take any other form. Furthermore, it is to be understood that the directional terms employed herein, such as front, rear, upper, lower, undersurface, vertical, horizontal and the like, refer to the normal orientation of the parts in use, and such terms are employed for the purpose of description and are not intended to be limiting.

As shown and described, the auxiliary rifle sight of the present invention enables accurate positioning and placement of the rear and front sight devices of the auxiliary rifle sighting device into coacting engagement with the pre-existing geometrical configuration of the front and rear portions of the telescope mounting elements to provide iron sights for use in lieu of an impaired telescope.

While there have been shown and described preferred embodiments, it is to be understood that various other adaptations and modifications may be made within the spirit and scope of the invention.

What 1 claim is:

1. An auxiliary open rifle sight arrangement for replacing the telescope of a rifle having telescope mounting elements attached thereto or integral therewith at the receiver thereof for supporting a telescope relative to the rifle receiver at at least two spaced apart points generally corresponding to the front and rear portions of the telescope barrel, said arrangement comprising:

rear open sight means configured for fitting into coacting interengagement with the pre-existing geometrically configured rear portion of the telescope mounting element;

coupling means for coactingly engaging said rear sight means and existing portions of the rear portion of the telescope mounting elements; and front open sight means configured, dimensioned and arranged for coacting engagement with and mounting to existing portions in the front portion of the telescope mounting elements of the rifle, said front sight means including a sighting member for alignment with the rear sight means for use as a rifle sight in lieu of the telescope.

2. The auxiliary rifle sight of claim 1 wherein said rear sight means includes cutout means and said coupling means includes a matingly configured portion for being received within said cutout means.

3. The auxiliary rifle sight of claim 1 wherein said rear sight means includes a block member having cutout portions in opposing sides thereof, and wherein said coupling means includes a matingly configured portion for being received within said cutout portions.

4. An auxiliary rifle sight arrangement for replacing the telescope of a rifle having telescope mounting elements attached thereto or integral therewith at the receiver thereof for supporting a telescope relative to the rifle receiver at at least two spaced apart points generally corresponding to the front and rear portions of the telescope barrel, said arrangement comprising:

rear sight means having a portion thereof configured for engagement with the rear portion of the telescope mounting elements;

coupling means for coactingly engaging said rear sight means and existing portions of the rear portion of said telescope mounting elements; and front sight means, said front sight means being configured, dimensioned and arranged for coacting engagement with and mounting to existing portions in the front portion of the telescope mounting elements of the rifle.

5. The rifle sight arrangement of claim 4 wherein each of said front and rear sight means includes an open sight member.

6. The rifle sight arrangement of claim 4 wherein the telescope mounting elements are integrally formed in the receiver portion of the rifle.

7. The rifle sight arrangement of claim 4 wherein the telescope mounting elements include base means for attachment to the receiver portion of the rifle.

8. The rifle sight arrangement of claim 7 wherein said base means is a one-piece telescope mounting base member.

9. The rifle sight arrangement of claim 7 wherein said base means includes two mounting elements for mounting fore and aft of the receiver, respectively.

10. The rifle sight arrangement of claim 9 wherein each of said mounting elements includes keying means and each of said front and rear sight means includes means for coacting engagement with said keying means.

11. An auxiliary rifle sight arrangement for replacing the telescope of a rifle having telescope mounting base means attached thereto at the receiver thereof for supporting a telescope relative to the rifle receiver at at least two spaced apart points generally corresponding to the front and rear of the portions of the telescope barrel, said arrangement comprising:

rear open sight means having rear sight block means;

means for coupling said rear open sight means to the rear portion of the telescope mounting base means of the rifle, said coupling means including means for coacting engagement with existing portions of the telescope mounting base means; and front open sight means, said front open sight means being configured, dimensioned and arranged for coacting engagement with and mounting to existing portions in the front portion of the telescope mounting base means of the rifle.

12. The auxiliary rifle sight arrangement of claim 11 wherein said base means includes a base member which straddles the receiver opening of the rifle.

13. The auxiliary rifle sight of claim 12 wherein the front portion of the base member is provided with an aperture, and said front sight means includes a portion configured for being received within said aperture.

14. The auxiliary rifle sight arrangement of claim 13 wherein said aperture has a circular cross-section and said front sight means portion is matingly configured.

15. The auxiliary rifle sight arrangement of claim 11 further including means for fixedly attaching said front sight means to the base means.

16. The auxiliary rifle sight arrangement of claim 13 further including means threadably engaging said base member and said front sight means portion for fixedly attaching said front sight means to said base member.

17. An auxiliary open rifle sight arrangement for attachment to a rifle at the receiver thereof in lieu of a telescope, said arrangement comprising:

base means for attachment to the rifle at the receiver thereof, said means including front and rear spaced apart mounting sites, each of said sites having geometrically configured attachment means for receiving telescope holding means;

rear open sight means configured for fitting into coacting interengagement with the pre-existing geometrically configured rear portion of said base means, said rear sight means including a rear sighting member;

coupling means for coactingly engaging said rear sight means and existing portions of the rear mounting site of said base means; and front open sight means configured, dimensioned and arranged for coacting engagement with and mounting to existing portions in the front mounting site of said base means, said front sight means including a sighting member for alignment with the rear sighting member for use as a rifle sight in lieu of the telescope.

18. The auxiliary rifle sight of claim 17 wherein said base means includes a bar-shaped base member, and the geometrically configured attachment means at the front mounting site includes aperture means.

19. The auxiliary rifle sight of claim 18 wherein said aperture means includes a circular opening and said front open sight means are configured for being received therein.

20. The auxiliary rifle sight of claim 18 wherein said aperture means includes a somewhat rectangular opening and said front open sight means are configured for being received therein.

21. The auxiliary rifle sight of claim 19 wherein said rear sight means includes cutout portions and said coupling means includes a matingly configured portion for being received within said cutout portions.

22. The auxiliary rifle sight of claim 17 wherein said rear sight means includes a block member having cutout means in opposing sides thereof, and wherein said coupling means includes a matingly configured portion for being received within said cutout means and fastener means for attachment to said base means.

23. An auxiliary open rifle sight arrangement for use in lieu of a telescopic sight on a rifle, said arrangement comprising:

telescope mounting base means for attachment to the receiver of the rifle for supporting a telescope relative to the rifle receiver at at least two spaced apart points generally corresponding to the front and rear of the portions of the telescope barrel, said base means having geometrically configured portions at said two spaced apart point;

rear open sight means having rear sight block means;

means for coupling said rear open sight means to the rear portion of the telescope mounting base means of the rifle, said coupling means including means for coacting engagement with existing portions of the telescope mounting base means; and front open sight means, said front open sight means being configured, dimensioned and arranged for coacting engagement with and mounting to existing portions in the front portion of the telescope mounting base means of the rifle.

24. An auxiliary open rifle sight arrangement for attachment to a rifle in lieu of a telescope. said rifle having, at the receiver thereof, front and rear telescope mounting elements for attachment to the barrel of a telescope, said arrangement comprising:

mounting means integrally formed in the receiver portion of the rifle including front and rear spaced apart mounting sites, each of said sites having geometrically configured portions for attachment thereto of telescope holding means;

rear open sight means configured for fitting into coacting interengagement with the pre-existing geometrically configured rear portion of said mounting means, said rear sight means including a rear sighting member; and front open sight means configured for fitting into coacting interengagement with the pre-existing geometrically configured front portion of said mounting means, said front sight means including a front sighting member alignment with the rear sighting member for use as a rifle sight in lieu of the telescope.

25. The rifle sight arrangement according to claim 24 wherein the geometrically configured portions of said mounting means for each of said front and rear mounting sites include opposing tapered side portions and each of said front and rear sight means includes means for matingly coacting with said tapered side portions.

26. The rifle sight arrangement according to claim 25 wherein the geometrically configured portions of said mounting means for each of said front and rear mounting sites include a keying slots, and wherein each of said front and rear sight means includes a keying member for matingly coacting with said keying slot.

* * * * *